US007614480B2

(12) United States Patent
Smiley

(10) Patent No.: US 7,614,480 B2
(45) Date of Patent: Nov. 10, 2009

(54) PORTABLE ORCHARD LADDER SUPPORT

(76) Inventor: Everett J. Smiley, P.O. Box 78, Oakford, IN (US) 46965

( * ) Notice: Subject to any disclaimer, the term of this patent is extended or adjusted under 35 U.S.C. 154(b) by 0 days.

(21) Appl. No.: 12/290,148

(22) Filed: Oct. 28, 2008

(65) Prior Publication Data

US 2009/0107766 A1 Apr. 30, 2009

Related U.S. Application Data

(60) Provisional application No. 61/000,814, filed on Oct. 29, 2007.

(51) Int. Cl.
*E06C 1/00* (2006.01)
*E06C 5/00* (2006.01)

(52) U.S. Cl. ..... 182/64.1; 182/68.1; 182/127; 182/17

(58) Field of Classification Search ..... 182/64.1, 182/68.1, 68.2, 127, 17, 180.2
See application file for complete search history.

(56) References Cited

U.S. PATENT DOCUMENTS

| | | | | | |
|---|---|---|---|---|---|
| 69,049 | A | | 9/1867 | Turner | |
| 141,126 | A | | 7/1873 | Eagon | |
| 362,609 | A | * | 5/1887 | Clator | 182/68.1 |
| 369,148 | A | * | 8/1887 | Wright | 182/17 |
| 441,872 | A | * | 12/1890 | Harvey | 182/121 |
| 447,429 | A | * | 3/1891 | Ives | 182/17 |
| 540,643 | A | * | 6/1895 | Davol | 182/67.5 |
| 552,180 | A | * | 12/1895 | Hardouin | 182/68.1 |
| 640,645 | A | * | 1/1900 | Fall | 182/51 |
| 657,932 | A | | 9/1900 | Gardner | |
| 1,381,397 | A | | 6/1921 | Briles | |
| 1,394,498 | A | * | 10/1921 | Hopkins | 182/17 |
| 1,496,201 | A | | 6/1924 | Baxter | |
| 1,518,303 | A | * | 12/1924 | Byberg | 182/64.1 |
| 1,812,119 | A | | 6/1931 | Ruse | |
| 2,046,516 | A | * | 7/1936 | Johnson | 182/16 |
| 2,186,119 | A | * | 1/1940 | Moen | 182/17 |
| 2,600,807 | A | * | 6/1952 | Rieser | 182/64.1 |
| 4,565,262 | A | * | 1/1986 | Hawkins | 182/116 |
| 4,798,262 | A | | 1/1989 | Margolies | |
| 5,454,446 | A | | 10/1995 | Zelikovitz | |
| 5,857,544 | A | | 1/1999 | Del Sole | |
| 5,960,906 | A | | 10/1999 | Henderson | |
| 6,053,284 | A | * | 4/2000 | Fountain | 182/180.2 |
| 6,253,876 | B1 | | 7/2001 | Cosgrave et al. | |
| 6,527,084 | B2 | | 3/2003 | Hrincu | |
| 6,820,723 | B2 | * | 11/2004 | Huber | 182/127 |
| 7,104,360 | B2 | * | 9/2006 | Atkins | 182/69.2 |
| 2002/0166723 | A1 | * | 11/2002 | Huber | 182/127 |
| 2006/0169536 | A1 | * | 8/2006 | Davis | 182/127 |
| 2008/0302601 | A1 | * | 12/2008 | Baker | 182/69.4 |

* cited by examiner

*Primary Examiner*—Katherine W Mitchell
*Assistant Examiner*—Daniel Cahn
(74) *Attorney, Agent, or Firm*—Frank D Lachenmaier

(57) ABSTRACT

The present invention relates generally to ladders and more specifically to auxiliary stands or supports for utilization with ladders where it is not possible or desirable to rest the top of the ladder legs against a vertical surface or roof edge guttering for support and the required work height is beyond the reach of a conventional step ladder.

8 Claims, 5 Drawing Sheets

PORTABLE ORCHARD LADDER SUPPORT

BACKGROUND

1. Field of Invention

The present invention relates generally to ladders and more specifically to auxiliary stands or supports for utilization with ladders where it is not possible or desirable to rest the top of the ladder legs against a vertical surface or roof edge guttering for support. It is also used where a step ladder is inadequate to reach the desired height such as picking fruit in an orchard, trimming tall hedges or doing other maintenance on trees and shrubs when the branches will not support the weight of a ladder and a worker.

2. Prior Art

The basic principle of free standing ladder supporting structures is well known in the art. An early device was described in U.S. Pat. No. 69,049 to Turner in 1867. Numerous improvements have been attempted since then but none have disclosed a unit that is relatively light weight and easy to move from one place to another over fairly rough and uneven ground and can be easily leveled for safe use.

SUMMARY OF THE INVENTION

An object of the Portable Orchard Ladder Support is to provide a support system for an extension ladder that allows it to be sustained in a forward leaning mode without the tops of the ladder legs resting against a vertical wall, eaves troughs or tree or shrub branches.

Another object of the Portable Orchard Ladder Support is to provide a support system for an extension ladder that is relatively light in weight and easily repositioned along a hedge for trimming, around a tree for picking fruit or other maintenance treatments, or along a wall for painting or other such activities.

Another object of the Portable Orchard Ladder Support is to provide a support system for an extension ladder that can traverse rough or even ground and can be readily re-leveled at each work site.

Another object of the Portable Orchard Ladder Support is to provide a support system for an extension ladder that is relatively inexpensive to construct.

Another object of the Portable Orchard Ladder Support is to provide a support system for an extension ladder that is easy to disassemble into component parts for storage and shipping.

Another object of the Portable Orchard Ladder Support is to provide a support system for an extension ladder where the support bars are extendable to stabilize taller ladders and the wheels are easily removable or lockable when the system is in position for use.

Another object of the Portable Orchard Ladder Support is to provide a support system where the distal ends of the extendable support bars have rubber insulating boots to eliminate grounding of assembly.

Another object of the Portable Orchard Ladder Support is to provide a support system where an optional adjustable roof interfacing support or tree branch attaching bracket is provided for additional stability when such use is possible.

Still further objects and advantages will become apparent from a consideration of the ensuing description and accompanying drawings. In the description, reference is made to the accompanying drawings which form a part thereof, and in which are shown, by way of illustration, specific embodiments in which the invention may be practiced. These embodiments will be described in sufficient detail to enable those skilled in the art to practice this invention, and be understood that other embodiments may be utilized and that structural changes may be made without departing from the scope of the invention. In the accompanying drawings, like reference characters designate the same or similar parts throughout the several views.

DRAWINGS

The invention is described with reference to the following drawings.

REFERENCE NUMBERS

| | |
|---|---|
| 10 | Portable Orchard ladder Support |
| 11 | weldment |
| 12 | stabilizer bar |
| 13 | horizontal tube base |
| 14 | front extension tube |
| 15 | forward leaning tube base |
| 16 | rear wheel bar |
| 17 | rearward leaning tube base |
| 18 | ladder support bar |
| 20 | ladder support brace |
| 22 | transport wheel |
| 24 | windlass support bar |
| 26 | windlass assembly |
| 28 | windlass support brace |
| 30 | front cable |
| 31 | axle |
| 32 | axle brace assembly |
| 34 | trailer hitch |
| 36 | draw bar |
| 38 | strap cross-bar chain |
| 40 | castor wheel |
| 42 | bubble level |
| 44 | retro-pressure bar |
| 46 | leveling jack |
| 48 | cable to ladder connector |
| 50 | bar connector rod |
| 52 | turnbuckle |

-continued

| | |
|---|---|
| 54 | latch pin |
| 56 | ladder |
| 58 | angle iron bar |
| 59 | square hole |
| 60 | grommet seal |
| 62 | extender bar |
| 64 | steel strap cross-bar |
| 66 | steel strap |
| 68 | transport wheel brake assembly |
| 70 | pivotal ladder support bracket and pivot pin |
| 72 | rear cable |
| 74 | insulating boot |
| 76 | tube connector |
| 78 | pivoting connector clamp |
| 80 | reach bar |
| 82 | roof support feet |
| 84 | pivot plate and lock |
| 86 | tree branch chains |
| 88 | reach bar slide |
| 90 | reach bar lock |
| 92 | pivotal bracket assembly |
| 94 | U-bolt |
| 96 | ladder retention chains |
| 98 | slidable ring |
| 100 | draw bar attachment hole |

DESCRIPTION

In order that the invention is fully understood it will now be described by way of the following examples in which Portable Orchard Ladder Support 10 is shown in FIGS. 1-9 with representative ladder 56 shown in phantom lines for illustration purposes only. Ladder 56 is not a part of this invention. Portable Orchard Ladder Support 10 is designed for ease of assembly and disassembly for minimum required storage space.

Figure 3:
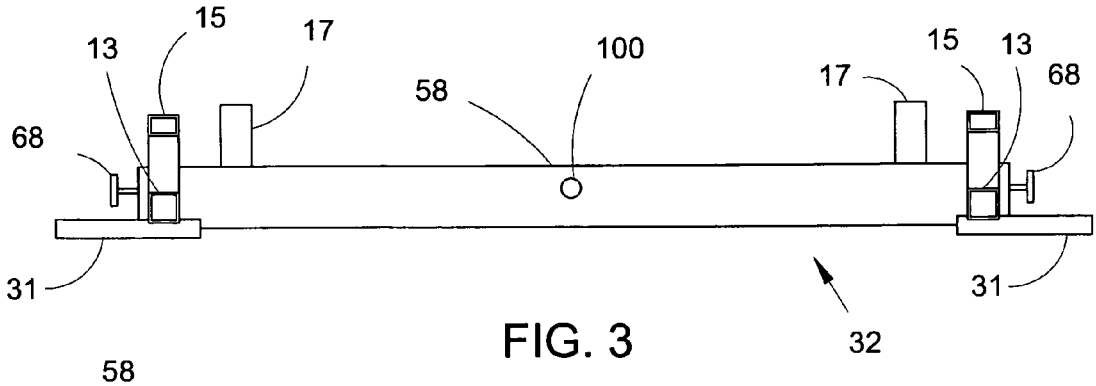
FIG. 3 is a rear view of axle brace assembly.
Figure 4:
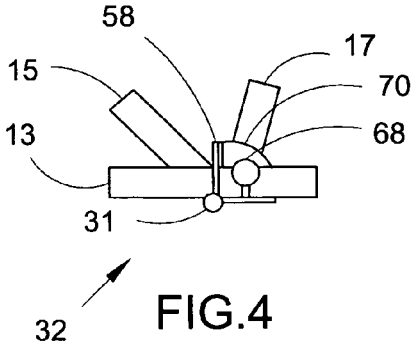
FIG. 4 is a side view of axle brace assembly.
Figure 4A:
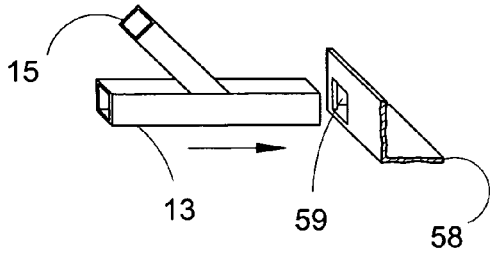
FIG. 4A is a partial exploded side perspective view of axle brace assembly.
Figure 5:
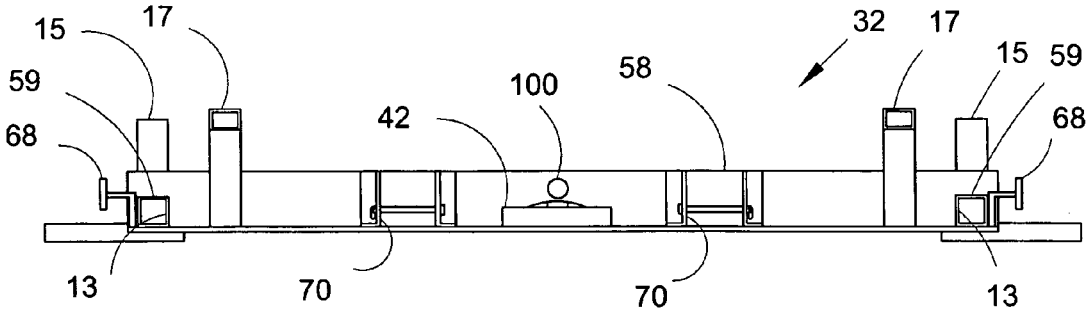
FIG. 5 is a front view of axle brace assembly.

Turning to FIGS. 3, 4 and 5 axle brace assembly 32 is disclosed with angle iron bar 58 preferably approximately 42 inches in width made from a 3 inch by 3 inch angle of ¼ inch cold rolled steel. Affixed to each end of angle iron brace 58 are axles 31 for transport wheels 22. There are two 1½ In. square holes 59 though the upstanding side of the angle, the bottom edge of which aligns with the top surface of the bottom side of angle iron brace 58. Square holes 59 are toward each end of angle iron brace 58.

Two weldments 11 are comprised of approximately 12 inch long by 1½ inch square horizontal tube bases 13 with approximately 6 inch long by 1½ inch square forward leaning tube bases 15 attached to the top surface of horizontal tube base 13 and leaning forward at approximately 45 degrees from the vertical. Forward leaning tube bases 15 are approximately centered on the 12 inch length of horizontal tube base 13. Back ends of horizontal tubes 13 are slipped through square holes 59 from the front until they seat the back edge of forward leaning tube base 15 against the front edge of upstanding side of angle iron bar 58 and weldments 11 are then welded to angle iron bar 58. Affixed to the top surface of the horizontal side of angle iron bar 58 just inside weldments 11 are two 1½ inch square rearward leaning tube bases 17 approximately 6 inches long leaning rearward at an angle of approximately 15 degrees. Also optional leveling jacks 46 can be placed under the ends of angle iron bar 58.

Figure 5A:
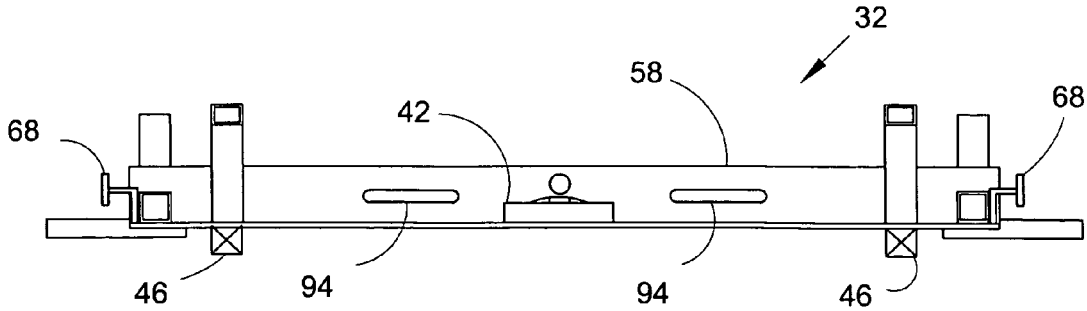
FIG. 5A is alternative front view of axle brace assembly replacing pivotal ladder support brackets with U-bolts.

There are friction transport wheel brake assemblies 68 mounted at either end adjacent to axles 31. Axle brace assembly 32 also includes bubble level 42 mounted in the center of angle iron bar 58 on the top of its horizontal side. Also mounted to the back surfaces of angle iron bar 58 are two pivotal ladder support brackets and pivot pins 70 that replace the standard pivoting feet on standard extension ladders. These are shown in FIG. 5 and in FIG. 8 where a pivot pin is run through the normal mounting holes for standard ladder pivoting feet with various ladder angle set points. Alternatively conventional ladder feet could be left on a conventional extension ladder 56 and the ladder legs secured to angle iron bar 58 with standard U-bolts 94 and leveling jacks 46 added under each end of angle iron bar 58 as shown in FIG. 5A.

Transport wheels 22 are mounted on axles 31 that extend out from axle brace assembly 32. Approximately 14 inch long by 1¼ inch square front extension tubes 14 are slipped into the front of 1½ inch square horizontal tube bases 13 with grommets seals 60 covering their sliding junctions and pinned in place with latch pins 54. Approximately 5 foot long by 1¼ inch square tubing windlass support bars 24 are slipped into top opening of forward leaning tube base 15 with grommets seals 60 covering their sliding junctions and pinned in place with latch pins 54. Windlass support brace 28 is an approximately 36 inch long by 1½ in square tube with the rearward face of the tube removed at each end by a sufficient length to allow brace 28 at its top end to slip over the sides of windlass support bar 24 and at its bottom end to slip over the distal end of front extension tube 14 with clearance holes for latch pins 54 used to secure the connections. Leveling jacks 46 are mounted on the under side of the distal end of front extension tubes 14 and windlass assemblies 26 slip over the distal ends of windlass support bars 24 again with the joints protected with grommet seals 60 and secured with latch pins 54.

Figure 7:
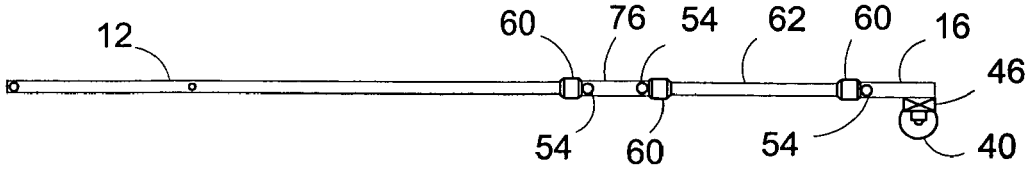
FIG. 7 is a partial side view showing stabilizer assembly with tube connector and extender.
Figure 7A:
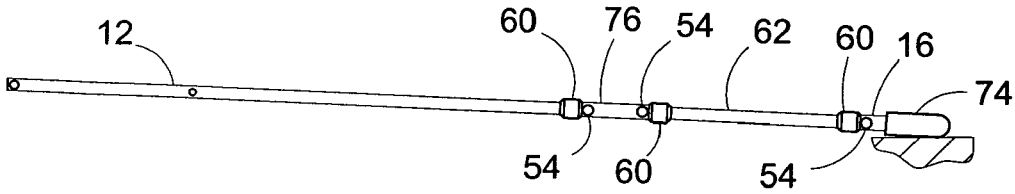
FIG. 7A is a partial side view showing stabilizer assembly with tube connector and extender with castor wheel removed and insulating boot added.
Figure 8:
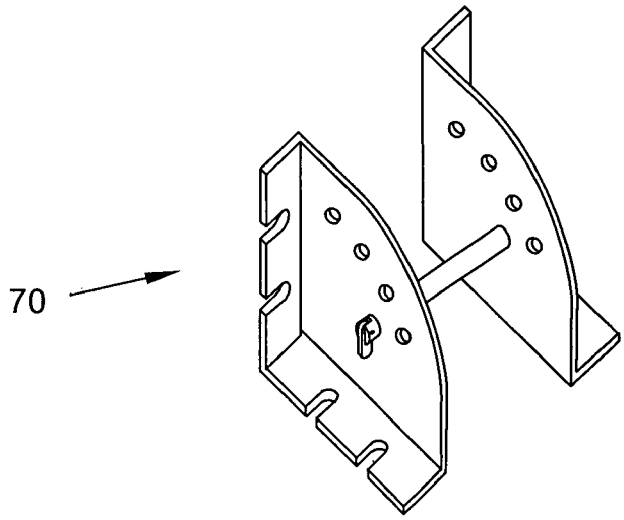
FIG. 8 is a partial perspective rear view showing pivotal ladder support brackets and pivot pins.

1¼ inch square tube stabilizer bars 12, approximately 5 feet long, are slid into the back end of horizontal tube bases 13, with the joints between stabilizer bars 12 and horizontal tube base 13 sealed with grommet seals 60 and secured with latch pins 54. 1½ inch square tube rear wheel bars 16 approximately 8 inches long, slip over the back ends of stabilizer bars 12 and the joints between them and rear wheel bars 16 are sealed with grommet seals 60 and secured with latch pins 54. Leveling jacks 46 are mounted on the under side of the distal end of rear wheel bars 16. For taller ladders, FIG. 7 shows an optional extension placed between the end of stabilizer bar 12 and rear wheel bar 16 by adding 1½ inch square tube connector 76, approximately 8 inches long, to end of stabilizer bar 12 and inserting 1¼ inch square tube extender bar 62, approximately 2 feet long, into rear of tube connector 76 and then sliding rear wheel bar 16 over the rear end of extender bar 62. Tube connector 76's joint with stabilizer bar 12 is sealed with grommets 60 and pinned in place with latch pins 54. Rear wheel bars 16 have castor wheels 40 suspended from their rear end. Alternatively, as shown in FIG. 7A, rear wheel bars 16 can have insulating boots 74 stretched over their rear ends to provide insulation for Portable Orchard ladder support 10 for doing elevated electrical work where grounding might become an issue.

Figure 1:
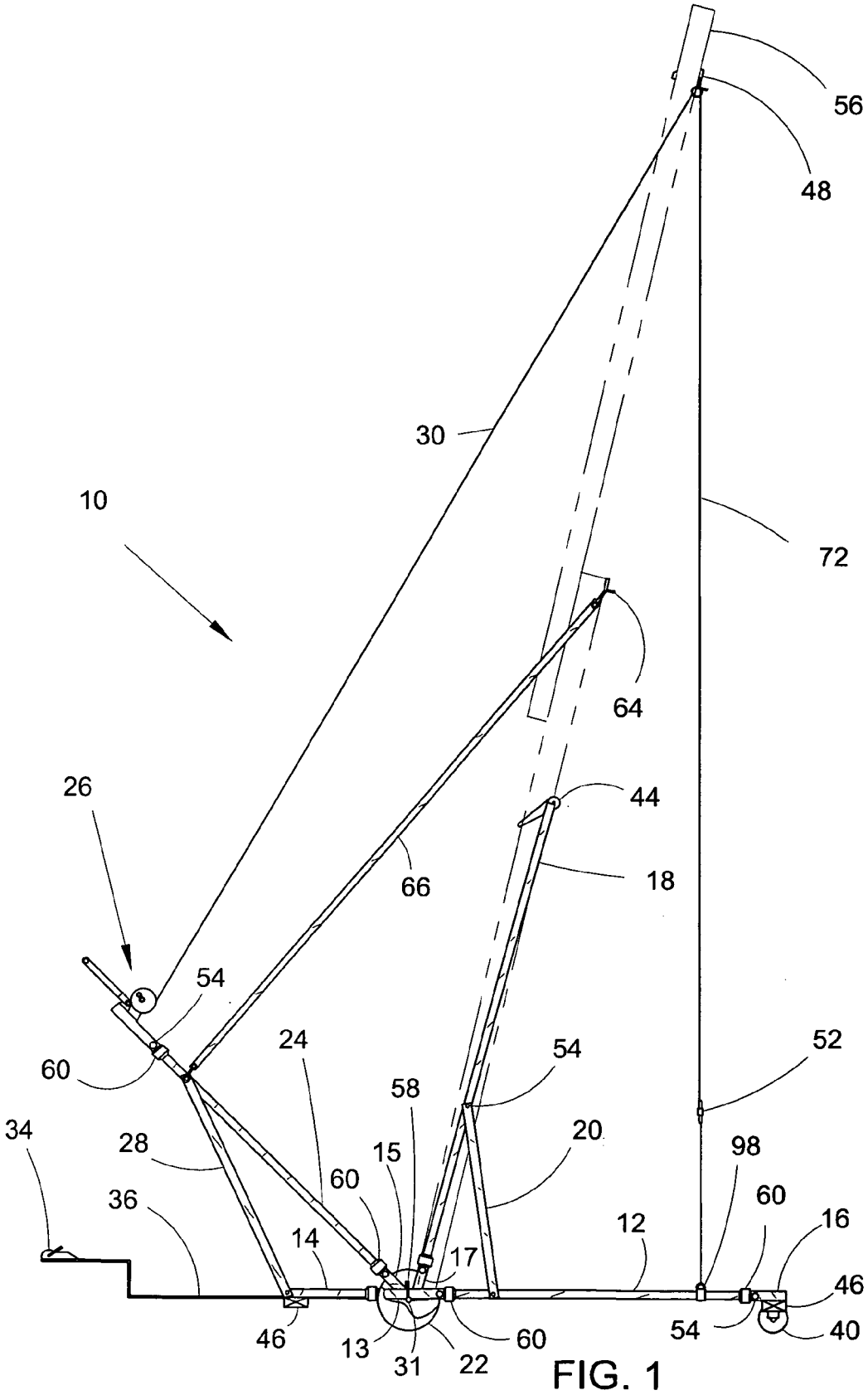
FIG. 1 is a side view of the Portable Orchard Ladder Support with an extension ladder mounted therein.
Figure 2:
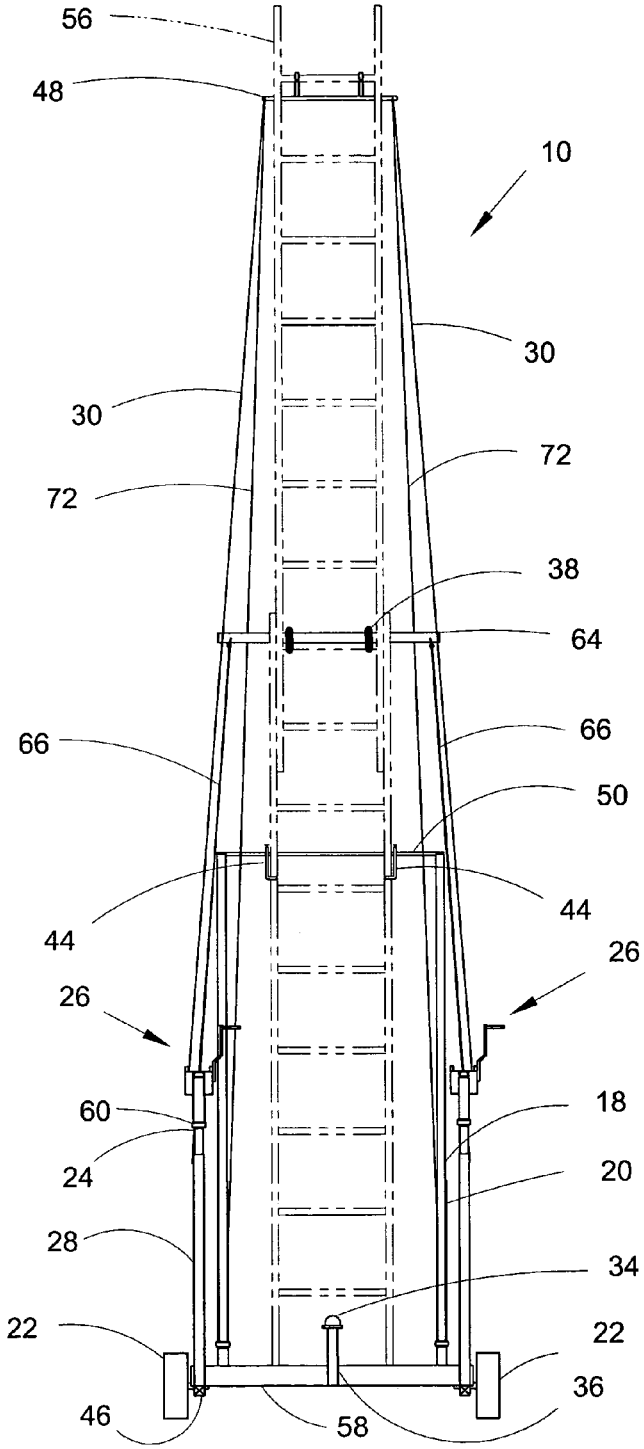
FIG. 2 is a front view of the Portable Orchard Ladder Support with an extension ladder mounted therein with retro-pressure bar ladder hold downs.
Figure 2A:
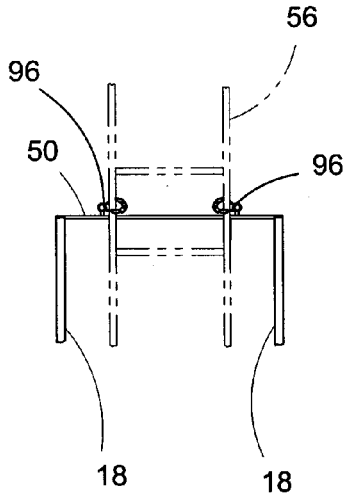
FIG. 2A is a partial front view showing alternative ladder retention chains replacing retro-pressure bars.

1¼ inch square tubing ladder support bars 18, approximately 7 feet long, are slid into rearward leaning tube bases 17 with the joint between support bars 18 and rearward leaning tube bases 17 sealed with grommets 60 and pinned with latch pins 54. At the top of support bars 18 are pivotally mounted retro-pressure bars 44 that clamp the ladder securely against ladder support bars 18 and can be held in place with a thumb screw device as shown in FIGS. 1 and 2. Alternatively, small ladder retention chains 96 are used with hooks to secure ladder 56 to distal ends of support bars 18 as shown in FIG. 2A.

Ladder support braces 20 are approximately 30 inch long by 1½ in square tubes with the forward face of the tube removed at each end by a sufficient length to allow support braces 20 to slip over the sides of ladder support bars 18 at its top end and to slip over stabilizer bar 12 at the bottom end with clearance holes for latch pins 54 used to secure the connections. Ladder support bars 18 are connected with bar connector 50 at their top ends.

steel straps 66 are approximately 12 ft long and 1 inch wide and ⅛ inch thick and are connected to windlass support bars 24 at the junction of windlass support braces 28 and windlass support bars 24 at the bottom end and connect to steel strap cross-bar 64 which is connected to top step of base ladder at the top end by strap cross bar chains 38 on each end. Steel strap cross-bar 64 is approximately a 36 inch wide 1½ inch by 1½ inch angle iron.

Each windlass assembly 26 has an approximately 28 foot long front cable 30 wound around its core which extends from windlass assembly 26 to cable to ladder connector 48. Cable to ladder connector 48 is comprised of two hooks that hook over the front and top of a step of a ladder in use well above ladder support bars 18. The hooks extend downward to a cross-bar with eyes for snaps at each end for front cables 30 to attach to. Said cross-bar goes behind the ladder such that when the windlasses are drawn tight the ladder is supported equally on each side by front cables 30. A second set of rear cables 72 drop from these connectors and are attached to the stabilizer bars 12 at slidable ring 98 as shown in FIG. 1. Rear cables 72 have turnbuckle 52 in the center to adjust the tension to a sufficient level as to reduce the bounce in Portable Orchard ladder Support 10 while it is supporting ladder 56 that is being climbed by a workman.

Figure 9:
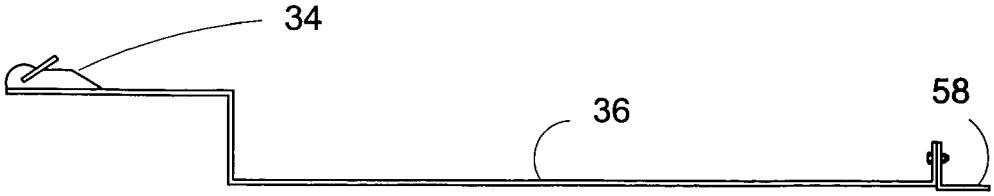
FIG. 9 is an enlarged partial side view showing draw bar and attachment; and the ladder shown in FIGS. 1, 2, 2A and 6 in broken lines is shown for illustration only and forms no part of this invention.

Draw bar 36 is shown in FIG. 9 as a stepped steel bar approximately 3 inches wide and ⅛ inch thick that has a proximal end bent up at 90 degrees with a bolt hole centered in bent up proximal end that aligns with draw bar attachment hole 100 in the center of the upstanding side of angle iron bar 58 as shown in FIGS. 3 and 5 for connection to or disconnect from axle brace assembly 32. Attached to the distal end of draw bar 36 with a step to match the pulling device hitch height, is a conventional trailer hitch 34 as shown in FIG. 9.

Figure 6:
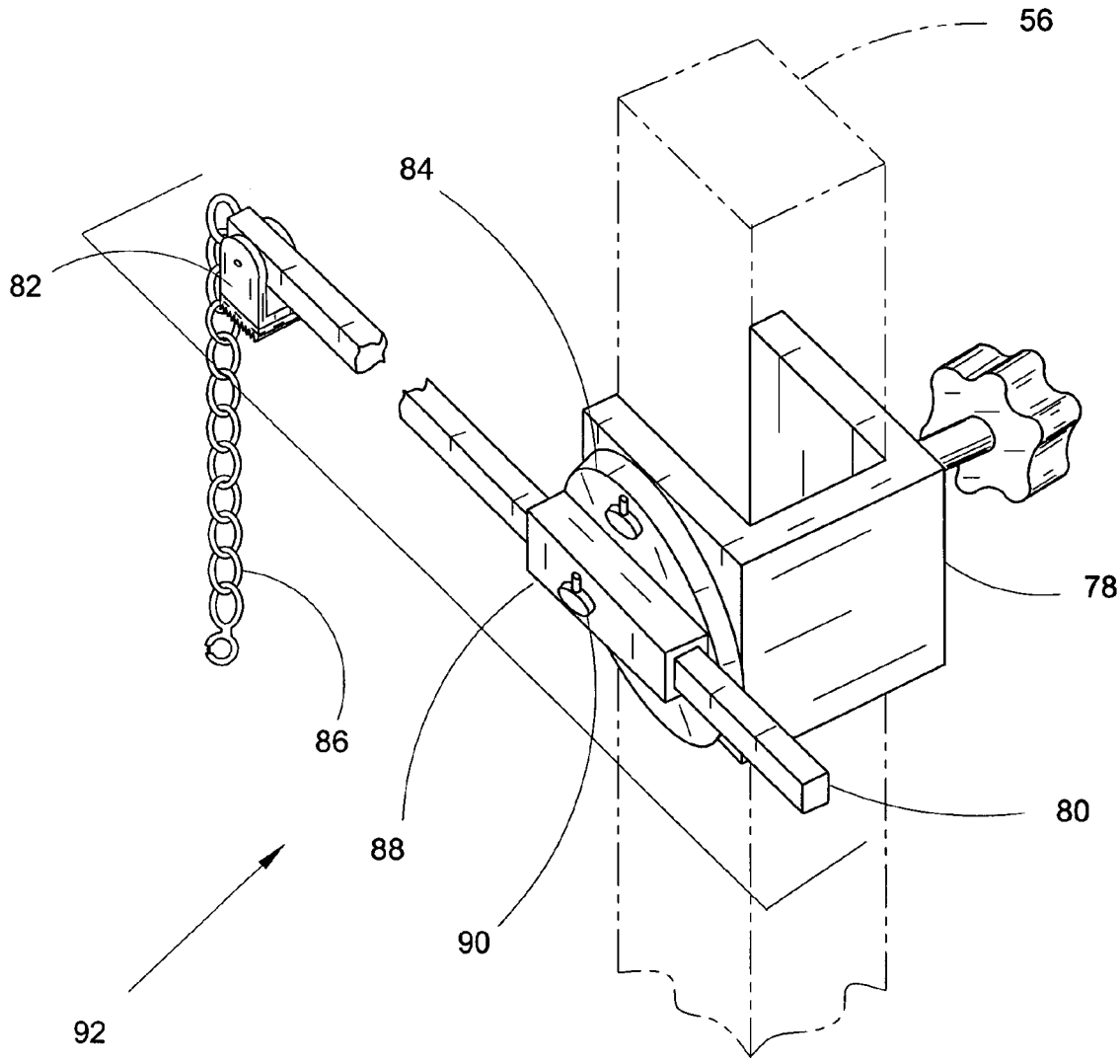
FIG. 6 is a perspective view of an optional attachment for use with roof or tree support.

An optional attachment is shown in FIG. 6 where pivotal bracket assembly 92 is used to support each leg of ladder 56 where either a roof or a large tree branch is available to provide additional stability. Pivotal bracket assembly 92 is comprised of pivoting connector clamp 78 attachable to the top of each leg of ladder 56. Connector clamps 78 are U-shaped brackets with clamping means that tighten against the ladder legs and with pivot plates 84 pivotally mounted to the outside of connector clamps 78. Pivot plate 84 has a 1¼ inch square tube reach bar slide 88 approximately 6 inches long attached to its outer surface. Reach bars 80 are 1 inch square bars, approximately 3 feet long and are slipped into reach bar slides 88 and secured in place with reach bar locks 90. At the distal ends of reach bars 80 are pivotally attached skid resistant roof support feet 82 that automatically align themselves to the pitch of whatever roof they are put in contact with. Pivot plate 84 can be rotated to the appropriate angle such that reach bars 80 are parallel to the pitch of roof mount, if so desired. Optionally tree branch chains 86 can be used to secure the distal ends of reach bars 80 to a large branch on a tree.

Although this invention has been described by detailing a preferred embodiment with several optional attachments it is not intended to be limited to this set of materials and dimensions. Rather, the scope of this invention is defined by the following claims.

What is claimed is:

1. A portable orchard ladder support system with a front end, a rear end, a top side and a bottom side for a free standing, forward leaning extension ladder that has slidably separate bottom and top sections that have parallel legs and a plurality of spaced apart rungs extending there between and an uppermost rung comprising:

an axle brace assembly comprised of:

an angle iron bar with a metal thickness, ends, an upstanding vertical wall with a front surface and a back surface, and a horizontal wall with a top surface and a bottom surface where said horizontal wall extends rearward from said vertical wall, two square holes through said vertical wall where square holes have top edges, bottom edges and outside edges and said bottom edges of said square hole are on the same plane as said top surface of said horizontal wall of said angle iron bar and said outside edges of said two square holes are at least twice said metal thickness from said ends of said angle iron bar;

a bubble level attached to center of said top surface of said horizontal side of said angle iron bar;

axles attached to said ends of said angle iron bar with transport wheel brake assemblies mounted adjacent to said axles;

two weldments each comprised of:

a horizontal tube base made from a square tube with a front end, a rear end, a length, inside dimensions, outside dimensions, a top surface, a bottom surface, side walls with latch pin clearance holes through both of said side walls of said horizontal tube base toward said front end and said rear end of said horizontal tube base, and a forward leaning tube base made from a square tube with a top end, a bottom end, inside dimensions, and side walls with latch pin clearance holes through both of said side walls toward said top end of said forward leaning tube base where said bottom end of said forward leaning tube base is cut at a 45 degree angle;

said bottom surface of said foreword leaning tube base is welded to the center of said top surface of said horizontal tube base where, said weldments of said horizontal tube bases and forward leaning tube bases are slipped through said square holes in said angle iron bar by inserting said rear end of said horizontal tube base through said square hole from said front surface of said upstanding vertical wall of said angle iron bar until rear edge of forward leaning tube base contacts said top edge of said square hole and are then welded to said angle iron bar;

two rearward leaning tube bases each made from a square tube with a top end, a bottom end, inside dimension, side walls, with latch pin clearance holes through said side walls toward said top ends of said rearward leaning tube bases where said bottom ends of said rearward leaning tube bases are cut at a 15 degree angle and are welded to said top surfaces of said horizontal walls of said angle iron bar adjacent to said inside wall of said weldments of said horizontal tube bases and said forward leaning tube;

two lower ladder leg attachment means that are connected to said back surface of upstanding side of said angle iron bar and said top surface of said angle iron bar;

two transport wheels that are mounted on said axles;

two windlass support bars each made from a square tube with a distal end, a proximal end, inside dimensions, outside dimensions, and two side walls with latch pin clearance holes through said side walls at said distal and proximal ends of said windlass support bars and approximately 6 inches below said distal end, where said square tube outside dimensions at said proximal end of said windlass support bars are slipped into said square tube inside dimensions of said top end of said forward leaning tube bases with a first grommet seal to cover a joint between said proximal ends of said windlass support bars and said top ends of said forward leaning tube bases and secured with latch pins snapped into said latch pin clearance holes;

two windlass assemblies with a rotating center, each built on a square tube with inside dimensions, a proximal end and sidewalls with latch pin clearance holes through both said side walls located toward said proximal end of said square tube where said square tube inside dimensions of said of said proximal end of said square tube slip over said square tube outside dimensions of said windlass support bar and the joint between said proximal end of said square tube and said distal end of said windlass support bar is protected with a second grommet seal and secured with latch pins snapped into said latch pin clearance holes, where said windlass assemblies have approximately 28 feet of a front cable wound around their rotating centers with a hand crank and a ratcheting lock system;

two front extension tubes each made from a square tube with a distal end, a proximal end, inside dimensions, outside dimensions and side walls with latch pin clearance holes through said side walls at said proximal end of said front extension tube, where said square tube outside dimensions of said front extension tube proximal ends are fit into said square tube inside dimensions of said front ends of said horizontal tube base where the joint between said front extension tube and said horizontal tube base are protected by a third grommet seal and secured with latch pins that snap into said latch pin clearance holes and have leveling jacks depending from the bottom of said distal ends of said front extension tubes;

two windlass support braces each made from a square tube with inside dimensions, outside dimensions, a front surface, a rear surface, and side walls, where said square tube inside dimensions of said windlass support brace are large enough to fit over said square tube outside dimensions of said front extension tubes and said windlass support bars where said rear surfaces of windlass support braces are open at each of said top and bottom ends with latch pin clearance holes in said side walls that match to said latch pin clearance holes in said side walls of said distal end of said front extension tubes and at intermediate location matching height of latch pin clearance holes in said windlass support bar and are secured in place with said latch pins which are snapped into said latch pin clearance holes;

two stabilizer bars each made from a square tube with a front end, a back end, inside dimensions, outside dimensions, and side walls with latch pin clearance holes through said side walls at said front and back ends of said stabilizer bars, where said square tube outside dimensions of said front end of said stabilizer bars fits into said square tube inside dimensions of said rear end of said horizontal tube base where the joint between horizontal tube base and stabilizer bar is protected with a fourth grommet seal and secured with said latch pins that snap into said latch pin clearance holes through said rear end side walls of horizontal tube base and said front end side walls of said stabilizer bars;

two ladder support bars each made from a square tube with inside dimensions, outside dimensions, a top end, a bottom end, and side walls with latch pin clearance holes through said side walls at said bottom end where said square tube outside dimensions of said ladder support bars fits into said square tube inside dimensions of said top end of said rearward leaning tube base and the joint between said ladder support bars and said rearward leaning tube base is protected with a sixth grommet seal and secured by latch pins snapped into latch pin clearance holes through said side walls of said ladder support bars and said rearward leaning tube bases;

two ladder support braces each made from a square tube with side, front and back surfaces, top and bottom ends, and inside dimensions where said front surface is opened at each end and said back surface is open at said bottom end a sufficient distance as to allow said square tube inside dimensions of said ladder support braces to slide over said square tube outside dimensions of said stabilizer bar at said bottom end of said ladder support brace and over said square tube outside dimensions of ladder support bars at said intermediate latch pin clearance hole location where latch pin clearance holes are provided in said side walls at each end of said ladder support braces where the joint between said ladder support braces and said stabilizer bar are secured by latch pins snapped into latch pin clearance holes in side walls of said stabilizer bars;

two rear wheel bars each made from a square tube with a front end, a rear end, inside dimensions, side walls with latch pin clearance holes through said front end side walls where said square tube inside dimensions slips over said square tube outside dimensions of rear end of said stabilizer bar and where the joint between said stabilizer bar and said rear wheel bar is protected with a fifth grommet seal and secured with latch pins snapped into said latch pin clearance holes through said side walls of said stabilizer bars and said rear wheel bars;

a bar connector rod that connects said two ladder support bars at said top ends and a mid-leg ladder attachment means that secures said bottom section ladder legs to said bar connector rod;

a steel strap cross-bar that is chained to the uppermost rung of the bottom section of said extension ladder;

a steel strap that is connected from each side of said steel strap cross-bar and connected to said windlass support bars at the height where said windlass support braces interface with said windlass support bars;

a cable to ladder connector that is constructed with two rods formed with hooks at the top ends of said rods where said hooks are of sufficient size as to hook over said uppermost rung of said top section of said ladder from the rear side of said extension ladder where the rods are connected at the bottom with a cross-bar with rings attached at both ends and said front cables from said windlass assemblies are snapped into said rings and said front cables are let out as extension ladder is raised and pulled tight and latched when ladder is at a desired operating height, and rear cables are also snapped into said rings and dropped straight down to tightening turnbuckles and then down to slidable rings attached to said stabilizer bar; and a draw bar is attached to center of said front surface of said upstanding vertical wall of said angle iron bar with step up to towing vehicle height with standard trailer hitch mounted thereon.

2. The support system of claim 1 where the bottom of ladder leg attachment means to said angle iron bar chosen from either pivotal ladder support brackets or U-bolts that trap the bottom of said ladder leg against said rear surface of said upstanding side of said angle iron bar.

3. The support system of claim 1 where mid-leg ladder attachment means is chosen from either a retro-pressure bar on each end of said bar connector rod with a pivotal arm that traps said leg of said ladder against said bar connector rod with a thumb screw to lock said retro-pressure bar in place once said ladder is mounted on said support system or it utilizes chains instead of retro pressure bars to hold said ladder against said bar connector rod.

4. The support system of claim 1 further comprising additional leveling jacks placed under each end of said angle iron bar.

5. The support system of claim 1 further comprising:

a pivotal bracket assembly comprised of a pivoting connector clamp with an outboard side on the top of each said ladder leg;

a rotatable pivot plate and lock mounted to said outboard side of said pivoting connector clamps;

a reach bar slide formed by attaching a square tube with a proximal and a distal end to said outboard side of said rotatable pivot plate;

two reach bars each formed from a square tube with a distal and a proximal end that are slipped into said reach bar slides, where the distance said distal end of said reach bar extends beyond the distal end of said reach bar slide is adjustable to allow a side wall clearance between a roof edge or guttering and said ladder legs;

two reach bar locks adjusted to secure said adjusted extension of said reach bar; and two roof support feet pivotally connected to said distal ends of said reach bars whereby additional stability can be achieved by placing said roof mounting feet onto a roof angled to the same pitch as the roof.

6. The support system of claim 5 further comprising tree branch attaching chains extending from said distal ends of said reach bars.

7. The support system of claim 1 further comprising extensions to said stabilizer bars to increase the stability for taller ladder extensions or heavier loads comprising:

a tube connector made from a square tube with a front end, a rear end, inside dimensions, outside dimensions and side walls that have latch pin clearance holes through said side walls toward both said front and rear ends where said square tube inside dimensions of said front end of said tube connector are large enough to slip over said square tube outside dimensions of said stabilizer bar; and an extender bar made from square tubing with a front end, a rear end, outside dimensions and side walls with latch pin clearance holes toward both said front end and said rear end of said extender bar where said square tube inside dimensions of said rear end of said tube connector are large enough to slip over said square tube outside dimensions of said front end of said extender bar, and square tube said outside dimensions of said rear end of said extender bar fits into said square tube inside dimensions of said front end of said rear wheel bar, with the joints between said rear end of said stabilizer bar and said front end of said tube connector and the joint between said rear end of said tube connector and said front end of said extender bar and the joint between said rear end of said extender bar and said front end of said rear wheel bar protected by a seventh, an eighth and a ninth grommet seal respectively and the connections secured with said latch pins snapped into said latch pin clearance holes.

8. The support system of claim 1 further comprising an insulating means chosen from either boots slipped over said rear ends of said rear wheel bars or leveling jacks depending from rear ends of said rear support bar with castor wheels depending from the under side of said leveling jacks.

* * * * *